US012256823B1

(12) United States Patent
Dimick

(10) Patent No.: US 12,256,823 B1
(45) Date of Patent: Mar. 25, 2025

(54) WIRELESS ACCESSIBILITY FINGERNAIL AND TOENAIL TRIMMER

(71) Applicant: Kyle Guy Dimick, Thornton, NH (US)

(72) Inventor: Kyle Guy Dimick, Thornton, NH (US)

( * ) Notice: Subject to any disclaimer, the term of this patent is extended or adjusted under 35 U.S.C. 154(b) by 0 days.

(21) Appl. No.: 18/824,829

(22) Filed: Sep. 4, 2024

Related U.S. Application Data

(60) Provisional application No. 63/639,410, filed on Apr. 26, 2024.

(51) Int. Cl.
*A45D 29/02* (2006.01)

(52) U.S. Cl.
CPC ..... *A45D 29/02* (2013.01); *A45D 2029/026* (2013.01)

(58) Field of Classification Search
CPC ..... A45D 29/02; A45D 2029/026
See application file for complete search history.

(56) References Cited

U.S. PATENT DOCUMENTS

| | | | |
|---|---|---|---|
| 3,596,667 | A | 8/1971 | Buercklin et al. |
| 4,117,854 | A | 10/1978 | Rosenbloom |
| 4,478,232 | A | 10/1984 | Yasuda |
| 4,564,034 | A | 1/1986 | Mackel |
| 4,896,684 | A | 1/1990 | Chou |
| 7,954,242 | B1 | 6/2011 | Brizan |
| 8,496,013 | B2 | 7/2013 | McCourtney |
| 10,076,173 | B1 | 9/2018 | Kaidi et al. |
| 10,506,861 | B1 | 12/2019 | Ma |
| 10,779,628 | B2 | 9/2020 | McMullen |
| 11,058,204 | B2 | 7/2021 | Shashou et al. |
| 11,382,397 | B1 | 7/2022 | Pao et al. |
| 2004/0094176 | A1 | 5/2004 | Daoting |
| 2007/0028936 | A1 | 2/2007 | Kriser |
| 2009/0119922 | A1 | 5/2009 | Doyle et al. |
| 2012/0204891 | A1 | 8/2012 | McCourtney |
| 2019/0145840 | A1* | 5/2019 | Kivioja ..... G01L 5/0038 73/862.541 |
| 2020/0275756 | A1 | 9/2020 | Amar |
| 2020/0297171 | A1 | 9/2020 | Ma |
| 2020/0375336 | A1 | 12/2020 | Hurter |
| 2021/0059379 | A1 | 3/2021 | McMullen et al. |
| 2022/0125178 | A1 | 4/2022 | Reeder et al. |
| 2022/0346350 | A1 | 11/2022 | Li |
| 2022/0395070 | A1 | 12/2022 | Pao et al. |
| 2023/0018641 | A1* | 1/2023 | McMullen, Jr. ..... A45D 29/02 |
| 2023/0112663 | A1 | 4/2023 | Brown |
| 2023/0218058 | A1 | 7/2023 | Taig |
| 2023/0294280 | A1 | 9/2023 | Apte |
| 2023/0320472 | A1 | 10/2023 | Terry |

* cited by examiner

*Primary Examiner* — Basil T. Jos
(74) *Attorney, Agent, or Firm* — Hanrahan Law Firm, P.A.; Benjamin M. Hanrahan, Esq.

(57) ABSTRACT

A fingernail and toenail trimmer is presented herein. The trimmer includes a stable, traction-providing base disposed on the bottom of a housing defining an interior portion. A nail cutting device with at least one blade is disposed at least partially within the housing and accessible through an opening in the housing. A high-torque drive mechanism drivingly engages the cutting device to effectively cut any fingernail or toenail. At least one camera, sensor and artificial intelligence module provides assistance with the accurate operation of the trimmer. The camera captures the environment surrounding the blades and transmits the images captured therefrom to the user device and artificial intelligence module for processing.

17 Claims, 7 Drawing Sheets

WIRELESS ACCESSIBILITY FINGERNAIL AND TOENAIL TRIMMER

CLAIM OF PRIORITY/CROSS-REFERENCE TO RELATED APPLICATION

The present application is based on and a claim of priority is made under 35 U.S.C. § 119 (e) to provisional patent application Ser. No. 63/639,410, filed on Apr. 26, 2024, the contents of which are incorporated herein in their entirety by reference.

FIELD OF THE INVENTION

The present invention is generally directed to a fingernail and toenail trimmer, and more specifically to a wireless accessibility finger and toenail trimmer.

BACKGROUND OF THE INVENTION

Cutting and trimming fingernails and toenails in humans and in animals (e.g., canines, felines, etc.) is a standard practice in maintaining good hygiene, cleanliness and appearance. For example, oftentimes, short, well-trimmed and clean nails (including fingernails and toenails) is a sign of good hygiene and can help prevent the development of infections and the spread of diseases by preventing or restricting the accumulation of dirt and bacteria from under, on or around the nails.

Commonly, fingernails and toenails are trimmed by the individual, e.g., without assistance from another, using handheld or manually-operated clippers. When trimming fingernails, the user or individual must operate the clippers with one hand to trim the fingernails on the other hand. This can be difficult in many cases, including for example, when using the non-dominant hand to operate the clippers to trim the nails on the dominant hand. Similarly, when trimming one's own toenails, the user must be able to physically reach his or her toenails by bending over and reaching to the toes. This can be difficult for many individuals, particularly elderly or older individuals, or those that may be overweight or otherwise unable to physically reach his or her own toes or toenails.

In some cases, the user or individual may have a physical ailment, disability or condition that may limit the ability or prevent the user from effectively or safely trimming his or her fingernails or toenails. As just an example, carpal tunnel syndrome (CTS) is a condition that can cause weakness in the individual's hands and can prevent the user from effectively or safely trimming his or her own fingernails or toenails. Of course other conditions or ailments in addition to or instead of CTS can also contribute to the inability to reach or effectively or safely trim one's own fingernails or toenails.

In this manner, as exemplified above, there are several accessibility and performance issues with existing formats of manual execution with devices in this field.

Accordingly, there is a demonstrated need to improve and automate this activity in whole or in part.

SUMMARY OF THE INVENTION

The present invention is generally directed to a fingernail and toenail trimmer that is designed to help people who have difficulty using standard fingernail and toenail trimmers. The trimmer of at least one embodiment includes a stable, traction-providing base disposed on the bottom of a waterproof or water-resistant housing. A nail cutting device disposed within the housing and at least partially protruding from or accessible through an opening includes one or more blades operated by a high-torque drive mechanism to effectively cut any fingernail or toenail, as desired. Some embodiments include multiple trimming modes, safety features to prevent injury, and the ability to trim nails through an application accessible on a user device that controls the trimmer.

In use, the trimmer is first placed on the floor, table, counter or other supporting or level surface. The user then lines up his or her fingernail or toenail with the one or more blades of the cutting device protruding from or accessible through a corresponding opening in the housing. The cutting device can be activated by selecting a button on an application on an electronic device, or by pushing or selecting a button provided on the side of the trimmer. Some embodiments include one or more wireless or wired batteries that can be charged in between uses.

One or more cameras, sensors and artificial intelligence modules can be used in some embodiments to provide more accurate cuts and to avoid or prevent injuries during use. More specifically, a camera can be mounted at or near the opening in the housing to capture the environment surrounding the blade(s). A sensor can be attached to or communicative with the cutting device or drive mechanism to measure and/or control the amount of force exerted to the cutting device. Images and/or live video feeds captured by the camera can be transmitted to the user device and/or to the AI module for processing.

BRIEF DESCRIPTION OF DRAWINGS

Like reference numerals refer to like parts throughout the several views of the drawings provided herein.

DETAILED DESCRIPTION OF THE INVENTION

Figure 1:
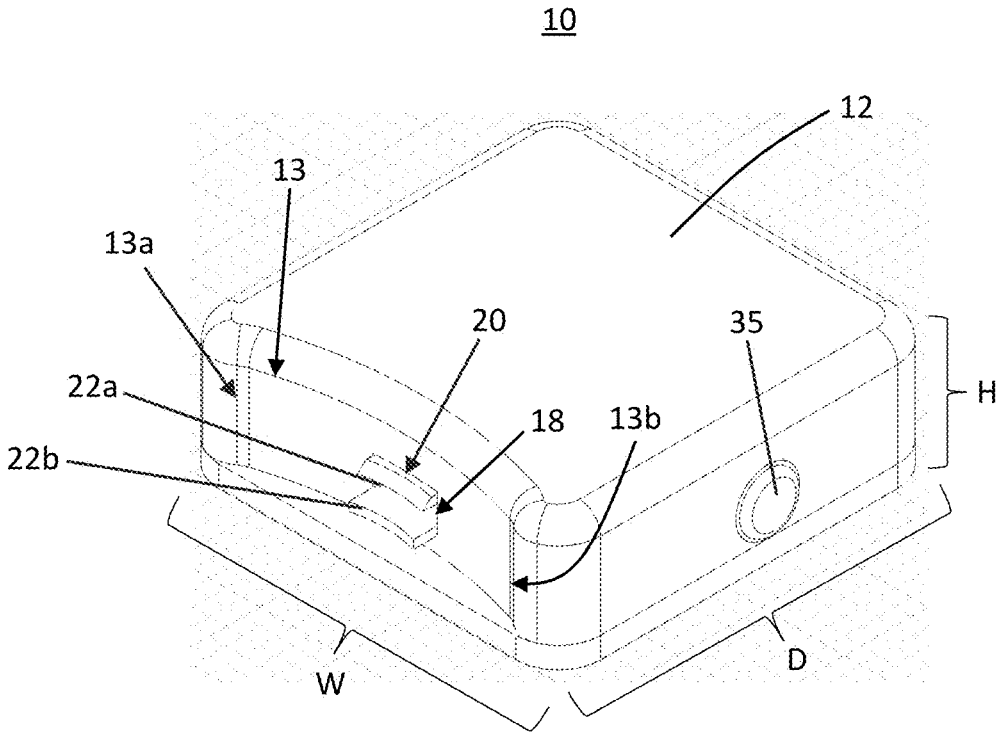
FIG. 1 is perspective view of the fingernail and toenail trimmer as disclosed in accordance with at least one embodiment of the present invention.

As shown in the accompanying drawings, and with particular reference to FIG. 1, at least one embodiment of the present invention is directed to a nail trimmer, generally shown as 10. It should be noted that the term nail, as used herein, refers to one or more fingernails or toenails of a human or animal, unless otherwise specifically stated.

More in particular, in at least one embodiment, the trimmer 10 includes a housing 12 that is formed to define an interior portion 15 thereof. The housing 12 of at least one exemplary embodiment includes a width W of approximately four inches, a depth D of approximately four inches, and a height H of approximately one and one-quarter inches. However, other dimensions of the housing 12, including the width W, depth D and height H are contemplated within the full spirit and scope of the present invention.

Figure 2:
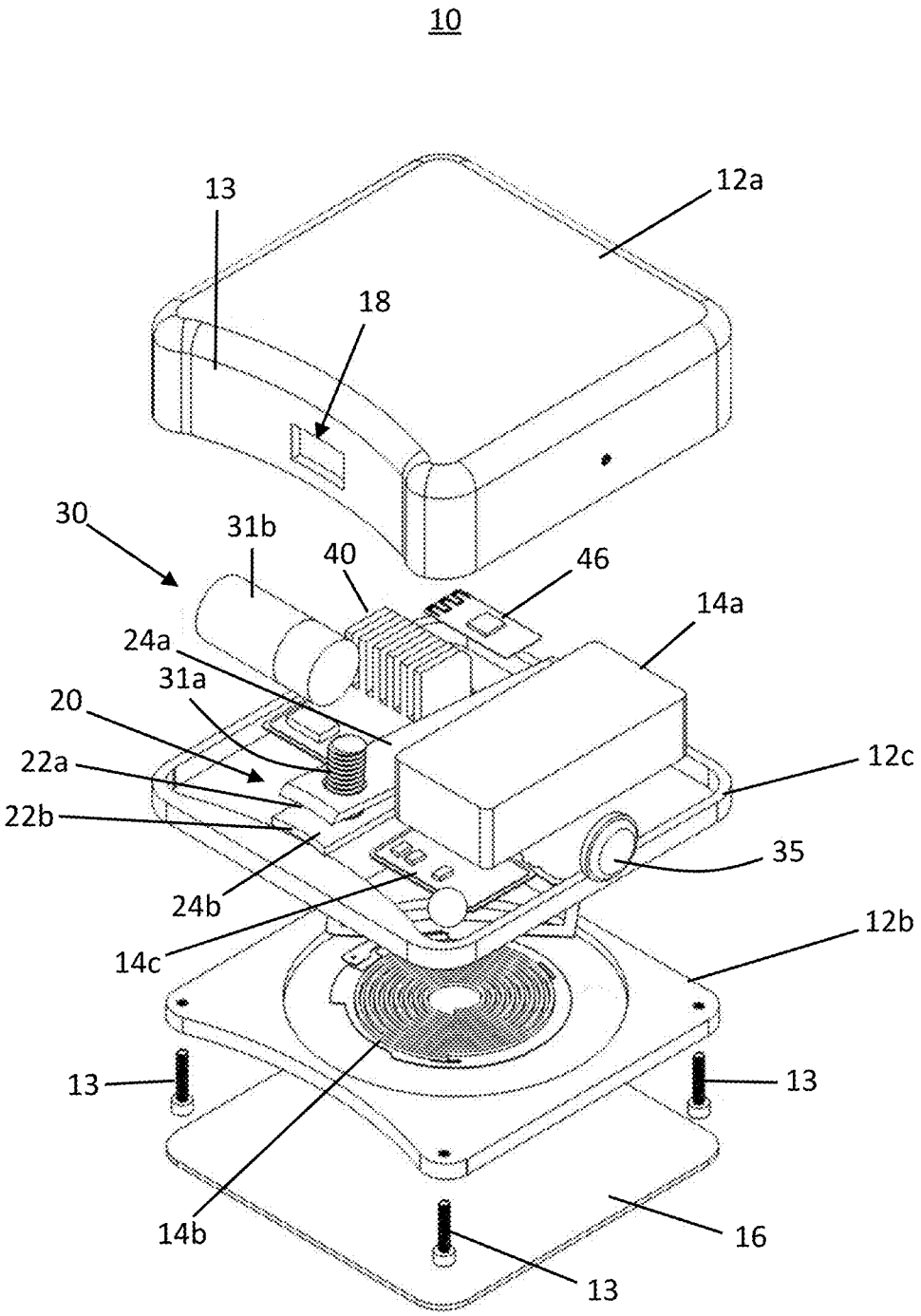
FIG. 2 is an exploded view of the fingernail and toenail trimmer as disclosed in accordance with at least one embodiment of the present invention.

With reference to the exploded view shown in FIG. 2, the housing 12 of at least one embodiment includes a top section 12*a* and a bottom base 12*b*. One or more fasteners may be used to secure the base 12*b* to the top section 12*a*, although other connection or attachment structures, including, for example, clips, snaps, grooves, protrusions, friction-fit components, etc. can be implemented.

In some cases, such as in the embodiment illustrated in FIG. 2, an internal tray 12*c* may also be included and disposed at least partially within the interior portion 15 between the top section 12*a* and base 12*b*. The tray 12*c* may be used to support or otherwise provide an attachment base for several components of the trimmer 10, as disclosed herein. It should be noted, however, that in other embodiments some or all of the components may be attached to or supported by the base 12*b* or other structures.

In some cases, one or more batteries or rechargeable power cells 14*a* may be disposed within the interior portion 15 of the housing 12 to operate or provide power to several components as described herein. The battery or power cell 14*a* of the various embodiments can be recharged through the use of a wireless charging pad or component 14*b* through wireless communication with an external wireless charger (not shown). In other embodiments, the battery 14*a* can be recharged through wired capabilities, for example, by connecting a cable between the battery 14*a* and an external charger (not shown). In this manner, also provided in the interior portion15 of at least one embodiment of the housing 12 is a power management unit 14*c* or a DC power management unit. The management unit 14*c* may be communicative with the battery 14*a* and in some cases with the wireless charging component 14*b*, and/or a processor 40, as described in more detail below.

In other embodiments, it is also contemplated that the trimmer 10 may include one or more replaceable batteries disposed within a waterproof or water-restricting compartment. In yet another embodiment, the trimmer 10 may be connected to a constant external power source for operation such that internal batteries may not be needed.

Furthermore, in at least one embodiment, the nail trimmer 10, and in particular the housing 12 thereof, is water proof or water resistant allowing the trimmer 10 to be used and/or otherwise operated in its intended manner in water or wet environments, including, but not limited to a shower or bath. Accordingly, in at least one embodiment, the housing 12 may form a water-tight seal that prevents or restricts water from entering the interior portion 15 thereof. In some cases, some or all of the internal components, for example, those supported by tray 12*c*, may either be capable of getting wet without impeding its performance or may include internal water-proof or water-restricting encasements or protections.

Additionally, still referring to the exploded view of FIG. 2, at least one embodiment of the present invention includes at least one bottom traction foot or pad, generally shown as 16. The bottom traction foot or pad 16 provides traction or movement-restricting capabilities to the trimmer 10 such that when the trimmer 10 is placed on a surface, such as a counter, a floor, a shower floor, a bath tub, etc. the bottom traction foot or pad 16 prevents or otherwise restricts movement of the trimmer 10 along the surface, particularly during use. In this manner, the bottom traction foot or pad 16 of at least one embodiment may be constructed of a rubber or other like material configured to provide traction as disclosed in accordance with at least one embodiment of the present invention.

Moreover, the present invention also includes a nail cutting device 20 that has at least one blade 22*a*, 22*b*, for example, on opposing jaws or arms 24*a*, 24*b*, for cutting or trimming a fingernail or toenail. The blade(s) 22*a*, 22*b* of at least one embodiment is/are accessible from a position external to the housing 12, and in some cases, extend at least partially through an opening 18 formed om the housing 12. In the embodiment shown, the nail cutting device 20 includes two arms 24*a*, 24*b* each defining operational ends that form an opening within which the user will place his or her nail. On at least one of the operational ends, or proximate to at least one of the operations ends, is a blade for cutting the nail. For example, in some cases, the top or first arm 24*a* may include a blade, whereas the bottom or second end may not and may instead form a flat or receiving portion upon which the blade engages when the cutting device is clamped or closed. In other cases, both of the arms 24*a*, 24*b* may each include a blade 22*a*, 22*b* at or proximate to the operational end.

In this manner, as described herein, a user can align a nail (e.g., a fingernail or toenail) with the one or more blade(s) 22*a*, 22*b* of the cutting device 20 to cut or trim the nail using the trimmer 10 of the present invention. In some cases, the housing 12 may include a water-restricting material or gasket formed around the opening 18 where the blade(s) 22*a*, 22*b* are exposed. The water-restricting material or gasket can prevent or restrict water from entering the housing 12. In some cases, the water-restricting material or gasket can also be used to restrict or prevent nail clippings from entering the trimmer 10, for example, immediately after being cut or trimmed from the nail.

Moreover, the housing 12 of at least one embodiment includes a front wall 13 through which the opening 18 is formed. In some cases, the front wall 13 may include a curvature or bend, such as an inward or concave curvature extending laterally along the front wall 13. In this manner, the opposing lateral sides 13*a*, 13*b* of the front wall 13 extend outward further than a center point of the front wall 13 or curvature thereof. Accordingly, the opening 18 may be disposed in the center or the concave curvature of the front wall 13, thereby providing an easy surface upon which to align the user's fingernails or toenails for cutting.

Furthermore, and still referring to the exploded view of FIG. 2, at least one embodiment of the present invention also includes a drive mechanism 30 disposed within the interior portion 15 of the housing 12 and in a driving relation with the nail cutting device 20. More specifically, the drive mechanism 30 is configured to dispose the nail cutting device 20 into a nail cutting or clamped position. In some cases, the drive mechanism 30 is also configured to position the nail cutting device 20 out of the clamped position.

More specifically, in at least one embodiment, and as mentioned briefly above, the nail cutting device 20 includes at least two arms 24*a*, 24*b*. On a distal or operational end of at least one of the arms 24*a*, 24*b* is a corresponding blade 22*a*, 22*b*. For example, a blade 22*a* may be disposed on an exposed, distal or operational end of arm 24*a*. In some cases, another blade 22*b* may be disposed on an exposed, distal or operational end of arm 24*b*. It should be noted, however, that in some cases, only one blade may be included, for example, blade 22*a* on the end of arm 24*a*. In such a case, the distal, exposed or operational end of arm 24*b* may not be sharpened or otherwise may not operate as a blade but may provide a surface upon which blade 22*a* engages when the nail cutting device 20 is disposed in the clamped position.

Particularly, in at least one embodiment, when the nail cutting device 20 is disposed in the clamped position, the distal, exposed or operational ends of the arms 24*a*, 24*b* meet one another or are otherwise drawn toward one another. If a nail is disposed within the nail cutting device 20 and between the distal, exposed or operational ends of the arms 24*a*, 24*b*, disposing the nail cutting device 20 into the clamped position will cut or trim the nail, for example, via the one or more blades 22*a*, 22*b* thereof.

There are several different embodiments in which the drive mechanism 30 can be used to operate the nail cutting device 20. In one such embodiment or example, the drive mechanism 30 may include a nut-and-bolt style mechanism that includes a threaded bolt 31*a* rotatingly attached to or engaged by a motor 31*b*. The clipping device 20 may include a fused nut or threaded portion, for example, fixed to the first or upper arm 24*a*, through which the threaded bolt 31*a* moves. As the threaded bolt 31*a* rotates (e.g., via the motor 31*b*), the nut or other like threaded component of the nail cutting device 20 does not rotate. This allows the nut or other threaded portion of the nail cutting device 20 to travel along the threaded bolt 31*a*, thereby causing the arm 24*a* to move between the open position (e.g., as shown in FIG. 2) and the clamped position where the ends of the arms 24*a*, 24*b* meet or engage with one another.

More specifically, as the nut or other threaded portion of the nail clipping device 20 travels up and down, or along the length of the bolt 31*a*, the blade(s) of the clipping device are forced together and apart. In this manner, the motor may be programmed or operational to spin in one direction a certain distance to close the blade(s) or arms, and in another direction for the same distance to open the blade(s) or arms. This action is repeated for each cut, for example, each time the user or device activates the trimmer 10, as disclosed herein. Accordingly, in at least one embodiment, the top or first arm 24*a* of the cutting device 20 may pivot or move relative to a bottom or second arm 24*b* in order to dispose the cutting device 20 into and out of the clamped position. In some cases, only one of the arms (e.g., the top or first arm 24*a*,) moves, while the other arm (e.g., the second or bottom arm 24*b*) remains stationary. In other cases, however, both arms 24*a*, 24*b* may move or pivot.

It should be noted that other embodiments or implementations of the trimmer 10 of the present invention may include other drive mechanisms 30 disposed in a driving relation with the nail cutting device 20. In other words, the nut-and-bolt style drive mechanism disclosed in accordance with one embodiment should not be considered limiting and other drive mechanisms are contemplated within the full spirit and scope of the present invention.

Furthermore, at least one embodiment of the present invention also includes an activator or activation button 35, which in at least one embodiment is accessible from a position external to the housing 12. Activation of the button 35 may, in some cases, be accomplished by pressing, depressing or pushing the button 35. In other cases, the button 35 may be activated through motion, touch, voice, etc., such that the button 35 may not be or need to be physically pressed or moved to activate. In any case, activation of the button 35 in at least one embodiment activates the drive mechanism 30 to drive the cutting device 20 into the cutting or clamping position, as described herein.

In this manner, operation of the trimmer 10 of at least one embodiment can be accomplished by a user aligning a fingernail or toenail with the one or more blades 22*a*, 22*b* of the cutting device 20 and activating the drive mechanism 30, e.g., though activation of the button 35. Doing so will cause the cutting device to clamp down onto and thereby cut the fingernail or toenail. This process can then be repeated for other fingernails or toenails, as desired.

Figure 3:
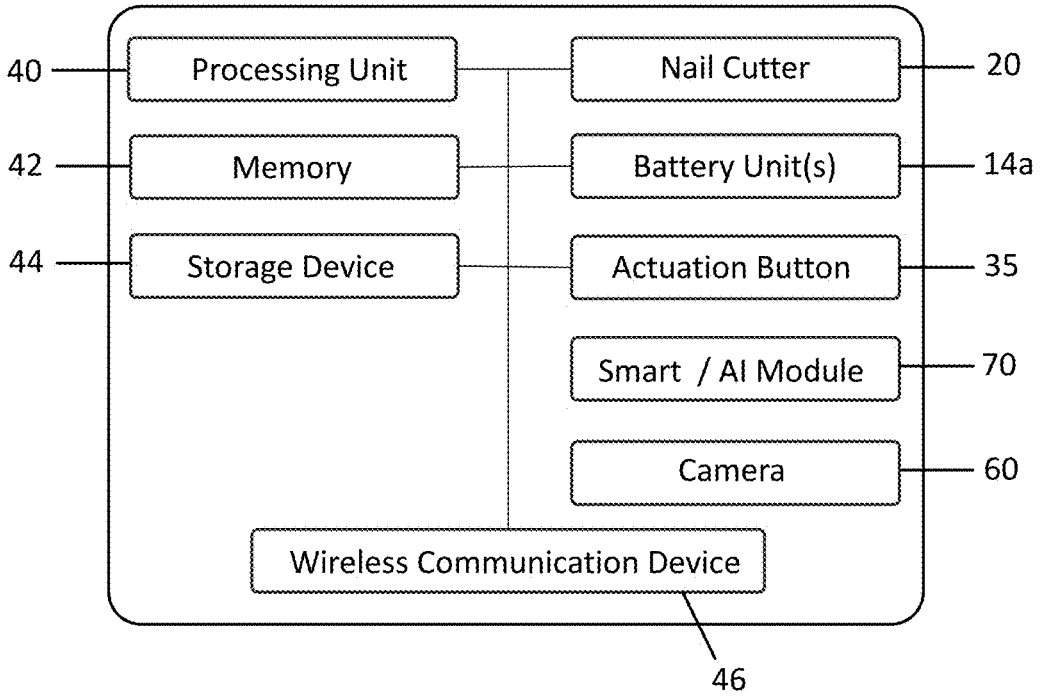
FIG. 3 is a block diagram illustrating several components of the fingernail and toenail trimmer as disclosed in accordance with at least one embodiment of the present invention.

With reference now to FIG. 3, the trimmer 10 of at least one embodiment of the present invention may include, among other components and devices structured to facilitate implementation of the present invention in the intended manner, a processor 40, memory 42, one or more data storage devices 44, and one or more communication or network device(s) 46.

Specifically, as used herein, the processor 40 of at least one embodiment may include any device cooperatively structured to execute or implement computer instructions, software, etc., including, for example, the various features and components as described in accordance with at least one embodiment of the present invention and configured to implement or facilitate the implementation of the method 100 herein. Further, the memory device 42, as used herein, may include but is not limited to random access memory (RAM) or other like device(s) configured to implement the present invention in the intended manner, for example, by storing and assisting with the execution of one or more applications, modules, or components capable of implementing the systems and methods described herein. It should be noted that non-transitory computer readable media includes all computer-readable media except for a transitory, propagating signal. The data storage device(s) 44, as used herein, may include a hard disk drive, solid state drive, virtual drive, cloud-based storage drive, or other types of volatile or non-volatile memory. Moreover, the communication device 46 may include a network communication hardware/software component, including but not limited to a Bluetooth wireless transceiver, structured to facilitate communication between the trimmer 10 of the present invention and the various user devices, as described herein.

Moreover, in at least one embodiment, the processor 40 is communicatively connected with various other components of the present invention, including, for example, the drive mechanism 30, the activator or button 35 and the wireless communication device 46. In this manner, activation of the button 35, in some cases, will cause the processor or processing unit 40 to activate the drive mechanism 30 to dispose the nail cutting device 20 into the clamped position, as described herein.

Figure 4:
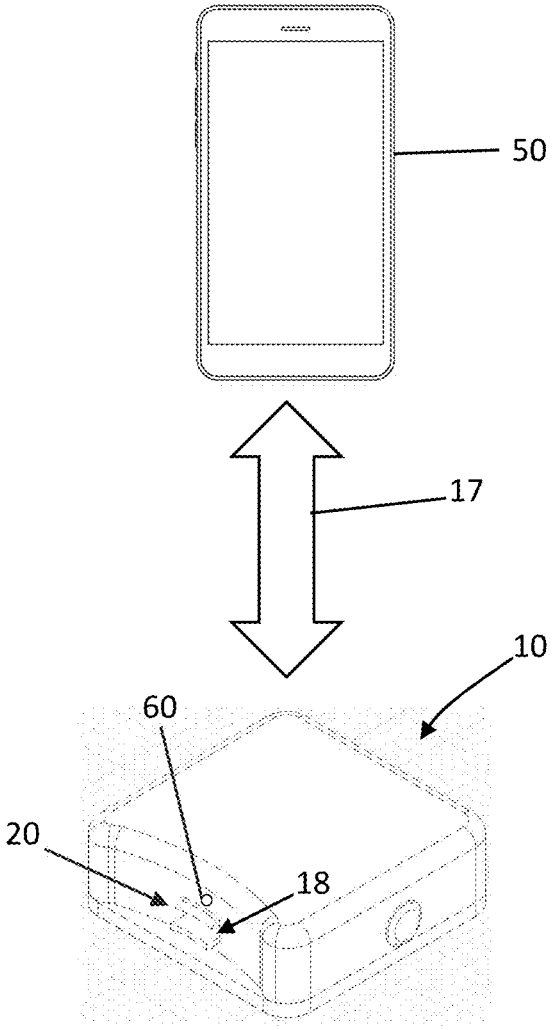
FIG. 4 is a schematic drawing showing a user device in communication with the fingernail and toenail trimmer as disclosed in accordance with at least one embodiment of the present invention.

Furthermore, with reference now to FIG. 4, in at least one embodiment, the trimmer 10 is communicative with a user device 50, for example, via a wired or wireless communication network or protocol, as generally shown by arrow 17. As an example, the network or wireless connection between the trimmer 10 and the one or more user devices may include virtually any computer, communication or data network such as a Bluetooth wireless network, Zigbee network, local area network, private area network, the World Wide Web, Internet, Intranet, Wide Area Network(s), Telecommunication Network(s) (e.g., 3G, 4G, 5G, LTE), etc.

Furthermore, the user device 50, as disclosed herein, may include virtually any computer-based device configured to or capable of implementing various aspects of the present invention. In this manner, the user device 50 may include, but is not limited to, a mobile device or mobile terminal such as, for example, a mobile phone, smartphone, tablet computer, etc., as well as a laptop or mobile computer, desktop computer, video game console, mobile video game device, etc. Accordingly, in some embodiments or implementations, the user or mobile device 50 may include, for example, an APPLE® iPHONE®, APPLE® iPAD®, ANDROID® based or GOOGLE® based phone or tablet, etc.

Accordingly, in at least one embodiment, the user device 50 is capable of accessing one or more of mobile application 52 as described herein. For example, the mobile application 52 may be downloaded and installed on the user device 50, accessed through a webpage or website, etc.

More in particular, the mobile application 52 of at least one embodiment includes one or more options or modules that are capable of facilitating implementation of the present invention in the intended manner by controlling or operating one or more aspects of the trimmer 10. In some cases, the application 52 may include a one-cut or manual mode, a rotating or continuous mode, and/or an automatic mode. The one-cut or manual mode, when selected or activated (e.g., via controls 53), allows the user to manually select or determine when the cut is to be made, or otherwise when the blade(s) is/are closed and/or opened. The rotating or continuous mode, when selected or activated, will cause the cutting device 20 to open and close in a predetermined or preset rhythm or pulse. The automatic mode, when selected or activated (e.g., via control 54), uses a smart module or artificial intelligence (AI) module, as described in more detail below, to determine various cutting features, such as when to cut, where to cut and how much force to use to cut the nail.

Figure 5A:
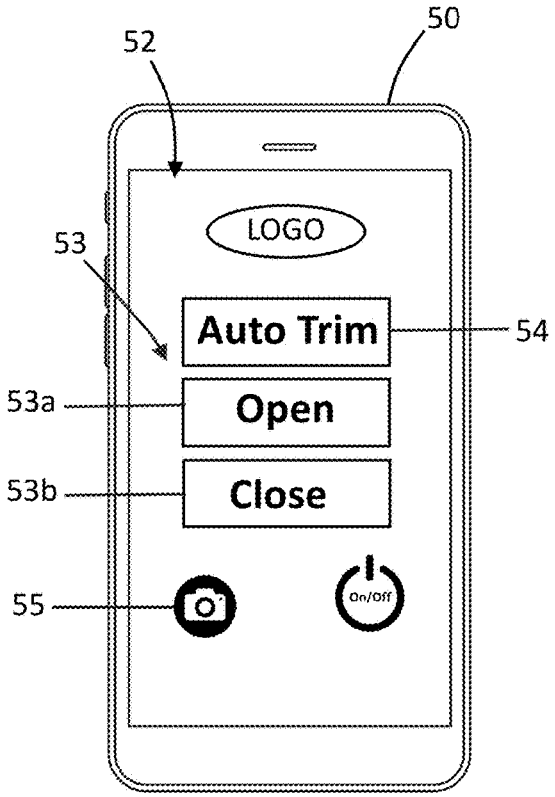
FIG. 5A is an exemplary illustration of the application accessible via the user device as disclosed in accordance with at least one embodiment of the present invention.

For example, in at least one embodiment, the application 50 includes an activation module or control(s), generally referenced as 53 in FIG. 5A, which, when selected causes the device 50 to communicate a signal to the trimmer 10 for the processing unit 40 to activate the drive mechanism 30 to dispose the cutting device 20 into the cutting or clamping position, or into an open position.

Specifically, the application 50 of at least one embodiment may include a button or selection 53*a* referenced as "open" or other like button, that when activated causes the trimmer 10 to separate or open the blade(s) 22*a*, 22*b* or arm(s) 24*a*, 24*b* of the cutting device, or otherwise ensure that that blade(s) or arm(s) of the cutting device are open. More specifically, if the blade(s) or arm(s) of the cutting device 20 are closed or clamped, activating the "open" selection 53*a* will cause the blade(s) or arm(s) to separate. Conversely, if the blade(s) or arm(s) of the cutting device 20 are open, activating the "open" selection 53*a* will either do nothing or ensure that the blade(s) or arm(s) are open or remain open and separated. It should also be noted that in some cases or embodiments, the cutting device 20 may automatically retract to the open position, such that a user may not need to specifically select an "open" option to open the blade(s) or arms.

Similarly, the application 50 of at least one embodiment may include a button or selection 53*b* referenced as "close" or other like button, that when activated causes the trimmer 10 to close or clamp the blade(s) 22*a*, 22*b* or arm(s) 24*a*, 24*b* of the cutting device. More specifically, if the blade(s) 22*a*, 22*b* or arm(s) 24*a*, 24*b* of the cutting device 20 are closed or clamped, activating the "close" selection 53*b* may do nothing or ensure that the blade(s) 22*a*, 22*b* or arm(s) 24*a*, 24*b* are closed. Conversely, if the blade(s) 22*a*, 22*b* or arm(s) 24*a*, 24*b* of the cutting device 20 are open, activating the "close" selection 53*b* will cause the blade(s) 22*a*, 22*b* or arm(s) 24*b* to close and thereby dispose the cutting device 20 into the clamped or cutting position.

Moreover, with reference to FIG. 4, for example, in at least one embodiment at least one camera, generally shown as 60, may be included on the trimmer 10, and in particular, at or near the opening 18, through which the cutting device 20 is accessed. The camera 60 is positioned to capture still or moving images (e.g., video) of the environment at or near the blade(s) 22*a*, 22*b* of the cutting device 20. Although FIG. 4 shows the camera 60 positioned above the opening 18, other positions including to one or both sides of the opening 18, below the opening 18, etc. are contemplated.

Figure 5B:
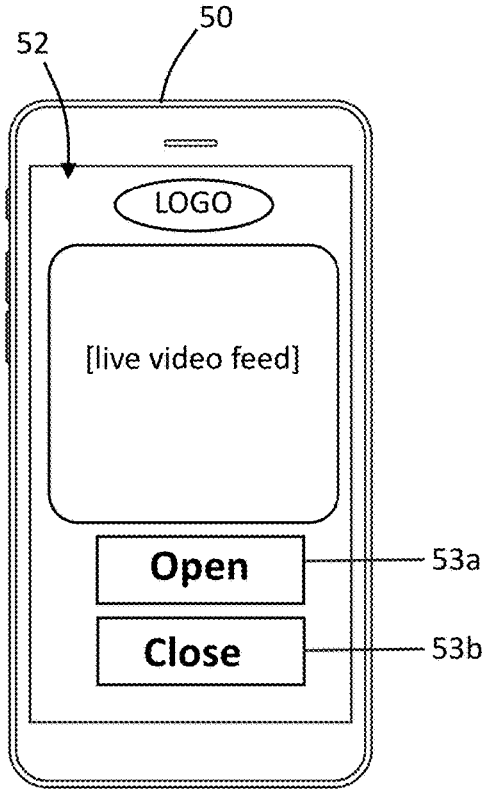
FIG. 5B is another exemplary illustration of the application accessible via the user device as disclosed in accordance with at least one embodiment of the present invention.

In this manner, the trimmer 10 of at least one embodiment is structured and configured to transmit the image(s) and/or video(s) to the user device 50, as generally shown in FIG. 5B, for example. More in particular, in at least one embodiment, through the processor 40 and/or communication device 46 of the trimmer 10, images and/or video can be transmitted through the network 17 to the user device 50, where the image(s) and/or video(s) can be displayed to the user, e.g., on the display screen and application 52 thereof. As just an example, the application 52 may include a button or selection, generally referenced as 55 in FIG. 5A, which the user can select to open the camera feed or display, as shown in FIG. 5B.

In some cases, the image(s) and/or video(s) captured by the camera 60 and transmitted from the trimmer 10 to the user device 50 can be a live video feed or a live visual feed showing the environment at the opening 18 and blade(s) 22*a*, 22*b* of the cutting device 20 in real-time or near real-time. This can be helpful to a user who may have difficulty bending over and reaching his or her toenails, thereby allowing the user to place the trimmer 10 on the ground or other surface and align his or her toenails with the blade(s) 22*a*, 22*b* of the cutting device 20 using the live video feed displayed on the user device 50. In some cases, the user may be able to zoom into or enlarge the video displayed on the user device 50 further assisting in the proper or desired alignment of the user's nails with the cutting device 20. Of course, other benefits and uses of the camera and live feed may be contemplated.

It should also be noted that, in some cases, the trimmer 10 of at least one embodiment may include, use or implement machine learning, large language model(s) (LLM) and/or other types of artificial intelligence (AI) systems, techniques or methods, whether integral with the trimmer 10 or external to the trimmer 10, to predict outcomes, determine when and where to cut the nail, determine how much force or pressure to apply to the cutting device 20, to stop or prevent a cutting motion of the cutting device (e.g., to prevent injury), etc.

In this manner, at least one embodiment of the present invention may include an artificial intelligence or smart module, generally referenced as 70 in FIG. 3, configured to provide assistance with the operation of the nail trimmer. The smart module or AI module 70 of at least one embodiment may be stored locally on the storage device 44 or remotely, for example, in a cloud-based or remote storage device, and/or operate wholly or at least partially through a third-party AI engine.

Moreover, the smart module or AI module 70 of at least one embodiment is communicative, directly or indirectly, with the camera(s) 60 to receive and process the image(s), video(s), etc. from the camera. Using at least one input, for example, the image(s), video(s), neural networks and predictive algorithms, the smart module 70 of at least one embodiment is able to or is configured to determine a cutting feature for achieving a desired or predicable and accurate cut of a nail (e.g., a fingernail or toenail). The cutting feature, as used herein, can include virtually any feature, parameter or control of the cutting device 20, such as, but in no way limited to, an angle of a cut, a location of a nail/skin boundary, a force to be exerted on the nail cutting device 20 via the drive mechanism 30, etc.

For example, the smart module or AI module 70 of at least one embodiment is capable of receiving an image or visual/video feed from the camera(s) 70, and based thereupon, determine which particular nail is shown in the environment of the image or video feed. For example, if a user places his or her right pointer finger into the environment captured by the camera 60 (e.g., at or near the cutting device 20), the smart module or AI module 70 of at least one embodiment is able to identify and determine that the finger shown is the user's right pointer finger. Similarly, if the user places his or her left pinky toe into the environment captured by the camera 60 (e.g., at or near the cutting device 20), the smart module or AI module 70 of at least one embodiment is able to identify and determine that the toe shown in the user's left pinky toc. This identification or determination of the particular finger, toe or nail shown in the environment can help the smart module 70 of at least one embodiment determine the cutting feature to be applied to the cut.

Figure 6A:
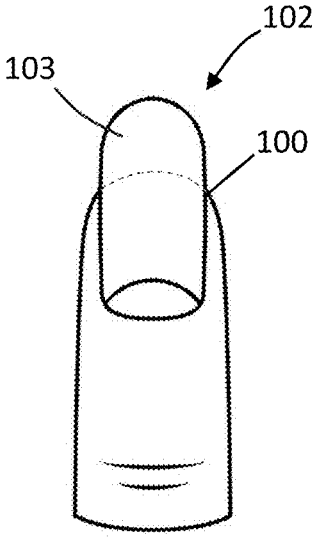
FIG. 6A is a top view of a finger and fingernail as disclosed herein.
Figure 6B:
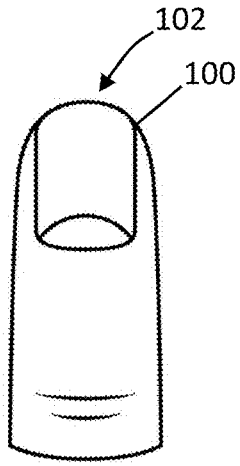
FIG. 6B is another top view of the finger and fingernail shown in FIG. 6A, with the fingernail trimmed using the trimmer as disclosed in accordance with at least one embodiment of the present invention.

Specifically, using the image(s), video(s) and/or other input, the smart or AI module 70 is able to determine a desired or ideal location of the cut while avoiding cutting skin or anything other than the nail. For example, with reference to FIGS. 6A and 6B, the smart or AI module 70 of at least one embodiment is able to identify the location of the nail 102 relative to the location of the user's finger or flesh represented by 100. In this example or illustration, the smart or AI module has determined that the best cut would be along line 105 cutting the nail top 103 off while avoiding contact with or any laceration to the finger or flesh 100.

In some cases, if the user moves his or her finger relative to the cutting device 20 of the trimmer 10 in a manner that would cause injury or laceration to the finger or flesh 100, the smart module or AI module of at least one embodiment is able to stop the operation of the drive mechanism 30 or otherwise not allow the cutting device 20 to clamp into the cutting position. This can be used as a safety feature that will restrict or prevent injury from occurring during use of the trimmer 10.

Figure 7:
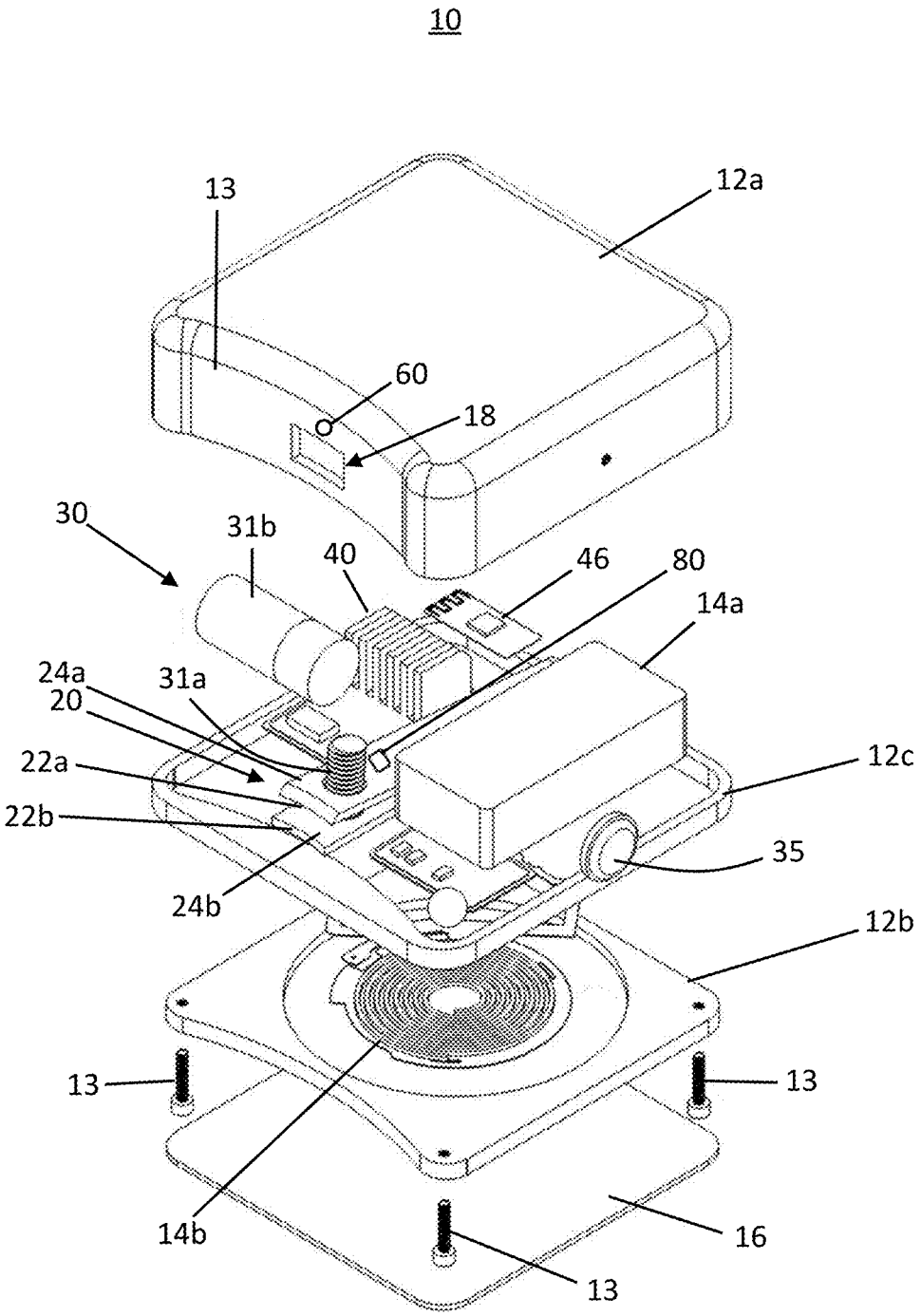
FIG. 7 is an exploded view of yet another embodiment of the fingernail and toenail trimmer as disclosed herein.

In yet another embodiment, as shown in the exploded view of FIG. 7, the present invention may also include one or more sensors 80 provided on, connected directly or indirectly to, or otherwise communicative with the cutting device 20 to measure a cutting force being exerted upon the cutting device 20 by the drive mechanism 30. More specifically, different fingernails and toenails often require different amount of force by the cutting device 20 to effectively make a clean and accurate cut. Several other factors can also impact the amount of force that is required or desired to make a clean and accurate cut, including, for example, the particular user (e.g., the same fingernail on different people may require difference forces), the age of the user, environmental factors, such as temperature, humidity, whether the trimmer is being used in a dry or wet environment, etc. Too little force and too much force can cause the nail to break, shard, or otherwise not cut in a clean manner, each of which can lead to injury to the user. For this, and other reasons, achieving an optimal force exerted by the cutting device 20 upon the nail for each nail, is desired.

Accordingly, using one or more sensor(s) 80, the amount of force exerted upon the cutting device 20 by the drive mechanism 30, and consequently exerted upon the nail by the cutting device 20, can be measured and controlled. In some cases, the user may be able to manually select a particular amount of force or range of force through the application 52 or other selection provided on the trimmer 10 itself.

However, in some embodiments, the force may be determined automatically by the smart module or AI module 70. For example, using the image(s), video(s) and/or other inputs provided by the camera(s) 60 or the user, the smart module or AI module 70 of at least one embodiment is able to determine which fingernail or toenail is shown in the environment captured by the camera, as described above. Using this information, the smart module or AI module 70 of at least one embodiment is then able to control or set the amount of force needed to provide a desired cut. The amount of force may vary depending on several factors, including, for example, which fingernail or toenail is to be cut, which user is using the trimmer, the age of the user, the ambient or other temperature of the room, the humidity of the room, when the trimmer is being used in a dry or wet environment, etc.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

The invention claimed is:

1. A nail trimmer comprising:

a housing defining an interior portion, a nail cutting device comprising at least one blade extending at least partially through an opening formed on said housing and accessible from a position external to said housing, a wireless communication device disposed within said interior portion of said housing and communicable with a user device, a drive mechanism disposed within said interior portion of said housing and in a driving relation with said nail cutting device, said drive mechanism being configured to dispose said nail cutting device into and out of a clamping position, an activator accessible from a position external to said housing, and a processing unit disposed within said interior portion of said housing, said processing unit being disposed in communication with said wireless communication device, said drive mechanism and said activator.

2. The nail trimmer as recited in claim 1 wherein said housing comprises a front wall through which said opening is formed.

3. The nail trimmer as recited in claim 2 wherein said front wall of said housing comprises a concave curvature extending laterally along said front wall.

4. The nail trimmer as recited in claim 3 wherein said opening is disposed in a center of said concave curvature.

5. The nail trimmer as recited in claim 1 wherein said nail cutting device comprises a stationary base and a movable arm, said movable arm being drivingly engaged by said drive mechanism.

6. The nail trimmer as recited in claim 5 wherein upon activation of said activator, said processing unit is configured to activate said drive mechanism to dispose said nail cutting device into said clamping position.

7. The nail trimmer as recited in claim 1 further comprising an application accessible on the user device, said application comprising an activation module, which when selected, communicates a signal to said processing unit to activate said drive mechanism to dispose said nail cutting device in said clamping position.

8. The nail trimmer as recited in claim 7 further comprising at least one camera disposed on said housing proximate said opening.

9. The nail trimmer as recited in claim 8 wherein said processing unit is configured to transmit, via said wireless communication device, a live visual feed captured by said camera of said at least one blade to said user device.

10. The nail trimmer as recited in claim 9 further comprises an artificial intelligence module to provide assistance with the operation of said nail trimmer.

11. The nail trimmer as recited in claim 10 wherein said artificial intelligence module is configured to:

receive an image from said camera, identify a particular nail captured in said image, and determine at least one cutting feature for achieving a clean and accurate cut of the particular nail.

12. The nail trimmer as recited in claim 11 wherein said at least one cutting feature comprises at least one of the following: cutting force exerted by said drive mechanism and angle of cut.

13. The nail trimmer as recited in claim 10 wherein said artificial intelligence module is configured to:

receive an image from said camera, identify a boundary of a nail captured in said image, and determine, as a safety feature, if said nail cutting device is aligned to cut anything other than the nail.

14. A nail trimmer comprising:

a housing defining an interior portion, a nail cutting device comprising at least one blade extending at least partially through an opening formed on said housing and accessible from a position external to said housing, a drive mechanism disposed within said interior portion of said housing and in a driving relation with said nail cutting device, said drive mechanism being configured to dispose said nail cutting device into and out of a clamping position, a sensor connected to said nail cutting device, said sensor being configured to determine an amount of force exerted upon said nail cutting device by said drive mechanism, a processing unit disposed within said interior portion of said housing, said processing unit being disposed in communication with said drive mechanism and said sensor, and an smart module configured to provide assistance with the operation of said nail trimmer, said smart module being configured to determine, via at least one input, at least one cutting feature for achieving a clean and accurate cut of a nail, wherein said at least one cutting feature comprises at least one of the following: a cutting force exerted upon said nail cutting device by said drive mechanism, an angle of a cut, and a location of a nail boundary.

15. The nail trimmer as recited in claim 14 further comprising a wireless communication device disposed within said interior portion of said housing and communicable with a user device.

16. The nail trimmer as recited in claim 15 further comprising at least one camera, wherein said at least on input comprises at least one image from said camera.

17. The nail trimmer as recited in claim 16 wherein said wireless communication device is configured to transmit a live video feed from said camera to said user device.

* * * * *